US005319531A

United States Patent [19]

Kutnyak

[11] Patent Number: 5,319,531

[45] Date of Patent: Jun. 7, 1994

[54] ILLUMINATED FLYING DISC WITH SPECIAL EFFECTS LIGHTING

[76] Inventor: Mark R. Kutnyak, S91 W22600 Fatima Dr., Big Bend, Wis. 53103

[21] Appl. No.: 979,090

[22] Filed: Nov. 19, 1992

[51] Int. Cl.[5] ..... F21V 33/00

[52] U.S. Cl. ..... 362/184; 362/253; 362/800; 273/424; 446/47

[58] Field of Search ..... 362/253, 157, 184, 231, 362/251, 800; 273/424; 446/47, 219, 438, 439, 485, 242

[56] References Cited

U.S. PATENT DOCUMENTS

| | | | |
|---|---|---|---|
| 3,786,246 | 1/1974 | Johnson et al. | 362/184 |
| 3,812,614 | 5/1974 | Harrington | 273/424 |
| 4,132,031 | 1/1979 | Psyras | 446/47 |
| 4,135,324 | 1/1979 | Miller et al. | 273/424 |
| 4,145,839 | 3/1979 | Sampetro | 446/47 |
| 4,301,616 | 11/1981 | Gudgel | 446/47 |
| 4,307,538 | 12/1981 | Moffitt | 446/47 |
| 4,563,160 | 1/1986 | Lee | 446/47 |
| 4,607,850 | 8/1986 | O'Riley | 273/424 |
| 4,778,428 | 10/1988 | Wield | 446/47 |
| 5,032,098 | 7/1991 | Balogh et al. | 273/424 |

*Primary Examiner*—Richard R. Cole
*Attorney, Agent, or Firm*—Quarles & Brady

[57] ABSTRACT

An illuminated, translucent flying disc includes electronic lighting and a lighting control. A plurality of high intensity light sources are centrally located below the disc in a protective center hub enclosure. The light sources distribute their alternating high intensity light rays radially outward along the top and bottom of the disc to the rim, flooding an angular area and rim of the disc with their alternating colored light rays, thus producing a high glowing effect through the opaque or translucent disc body. The controller for alternating the illumination of the light sources uses square wave timing circuitry.

9 Claims, 3 Drawing Sheets 11
54
12
60
45
59
46
55
58
57
17
13
14
6
PUSH ON
62
15
16

61
28
15
12
13
23
7
40
50
52
37
49
47
45
24
39
7
48
46
38
16
27
51
17
55
53
25
26
41
29
61
56
62
15

ILLUMINATED FLYING DISC WITH SPECIAL EFFECTS LIGHTING

BACKGROUND OF THE INVENTION

1. Field of the Invention

The invention relates to illuminated flying discs of the recreational type, which are tossed through the air from one player to another.

2. Description of Prior Art

There are various methods known in the art of illuminating flying discs for the addition of special effects. These include use of phosphorescent material or use of materials contained on special pods on the disc. This invention is directed to overcome the technical, visual and economic problems associated with this type of illuminated flying disc, using discrete light sources, such as small light bulbs or light-emitting diodes (LED's).

A typical flying disc has an upper deck that includes a flat central portion which extends radially outward to a downwardly turned leading edge. This leading edge gives the disc the profile of a wing. It also forms a transition surface between the flat portion of the upper deck and a depending rim that is provided for flight characteristics, in addition to a gripping surface during use.

Many different approaches have been taken to locating discrete light sources on such discs. These often have been located in housings or pods attached to the topside or underside of the disc and usually located centrally to maintain the balance of the disc during flight. When LED's are used, these are typically mounted in the depending rim for visibility at points radially outward of the disc. In other discs, the LED's are easily visible from the top or bottom, but special connections or other means must be provided to transmit light in the radial direction, with the LED's usually being of a low illumination value. The prior art does not provide a construction in which the discrete light sources are located so as to be seen from all vantage points, i.e. from above, below or radially outward of the disc. Since the disc can fly through the air at various elevations relative to the players, it would also be advantageous to provide a disc with light sources that are visible from as many directions as possible, in addition to illuminating the disc itself. It would also be advantageous to eliminate extra pods or housings for the light sources on or near the rim of the disc.

With a prior construction in which the light sources are located on or near the rim, there is a further problem that any exposure or projection of the light sources or special structures, no matter how small, may interfere with the tossing or catching of the disc. Another problem in this prior construction is the employment of wires or special circuits which are encased in melted plastic material, or mounted in grooves leading up to the discrete light sources. Although the circuitry is not exposed, it may become brittle and subject to damage or breakage.

There is thus a need for a less expensive, alternative and superior construction. Although a glowing effect is suggested in the art by discrete light sources, none are known which overcome the disadvantages of the prior art of lighted discs that are discussed above.

SUMMARY OF THE INVENTION

The invention relates to the lighting and glowing effects of a flying disc, including the selection, arrangement, positioning and control of discrete light sources in said disc. The present invention provides an improved radiant glowing disc, having an upper deck which extends radially outward to an adjoining leading edge. A support structure is centrally located on the underside of the disc for positioning a plurality of light sources, typically LED's, to provide visual streams of light, for contact with the disc's translucent body and rim. These LED's are connected to timing circuitry for alternate flashing to produce special effects both radially and around the rim of the disc.

Still a further aspect of the present invention is the positioning of the discrete light sources of various colors and arrangements.

In another aspect of the present invention, oscillating timer circuitry is employed to produce timed square pulse waves, enabling positive and negative current flow to occur. This doubles the output of the oscillating timer circuit, while producing visual effects which are observed in unison. This also allows the flash rates of the top and bottom LED's to be independent of one another.

Other objects and advantages, besides those discussed above, will be apparent to those of ordinary skill in the art from the description of the preferred embodiment, which follows. In the description, reference is made to the accompanying drawings, which form a part hereof, and which illustrate examples of the invention. Such examples, however, are not exhaustive of the various embodiments of the invention, and, therefore, reference is made to the claims which follow the description for determining the scope of the invention.

DETAILED DESCRIPTION OF THE PREFERRED EMBODIMENT

Figure 1:
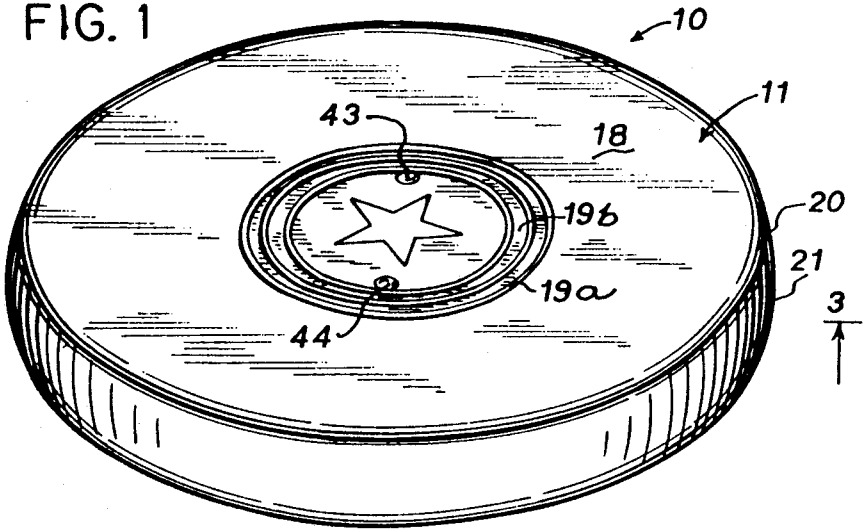
FIG. 1 is a perspective view of the lighted disc according to the present invention.
Figure 3:
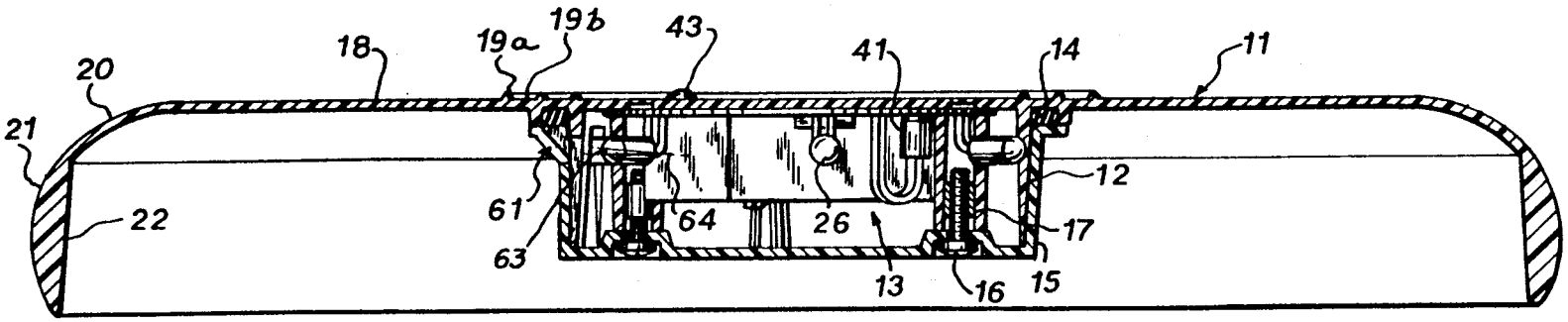
FIG. 3 is a sectional view taken in the plane indicated by line 3—3 in FIG. 2.
Figures 4, 5, 6:
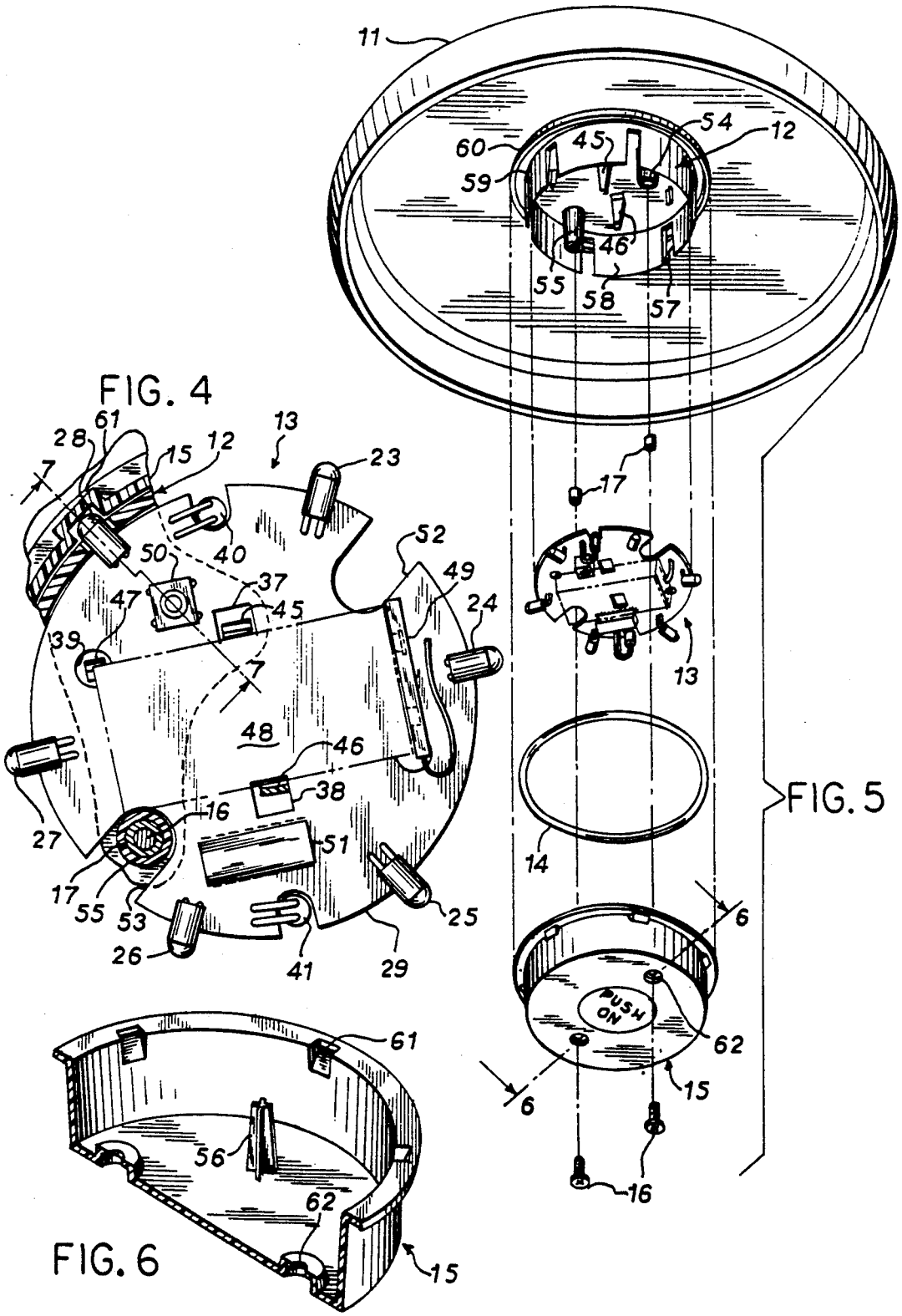
FIG. 4 is a plan view of a controller seen in the disc of FIGS. 1 and 2.
FIG. 5 is an exploded perspective view of the disc of FIGS. 1-3 and its components.
FIG. 6 is a sectional view taken in a plane indicated by line 6—6 in FIG. 5.

Referring to FIGS. 1, 3 and 5, the invention is incorporated in an illuminated flying disc assembly 10, which includes disc 11 with depending hub support structure 12, controller module 13, O-ring 14, hub cap 15 and hardware comprising screws 16 and threaded inserts 17. The disc 11 and cap 15 are preferably made of a translucent, durable, plastic material such as polypropylene, but in alternative embodiments, the material may be semi-opaque or opaque.

The disc 11 has an upper deck 18 with a planar central area extending over its largest part. A series of circular ridges 19a and grooves 19b are formed on the upper deck 18 to improve the aerodynamics of the disc 12 in flight. As seen best in FIG. 3, upper deck 18 has a leading edge 20 around the outside of the central area, and this edge 20 curves downwardly from the upper deck 18 to a rim 21 that depends from the upper deck. The rim 21 is reinforced to a greater thickness than the upper deck 18 and has a substantially flat, vertical interior wall 22, which encircles a cavity formed in the disc 11 and allows the rim 21 to be more easily grasped.

Figure 2:
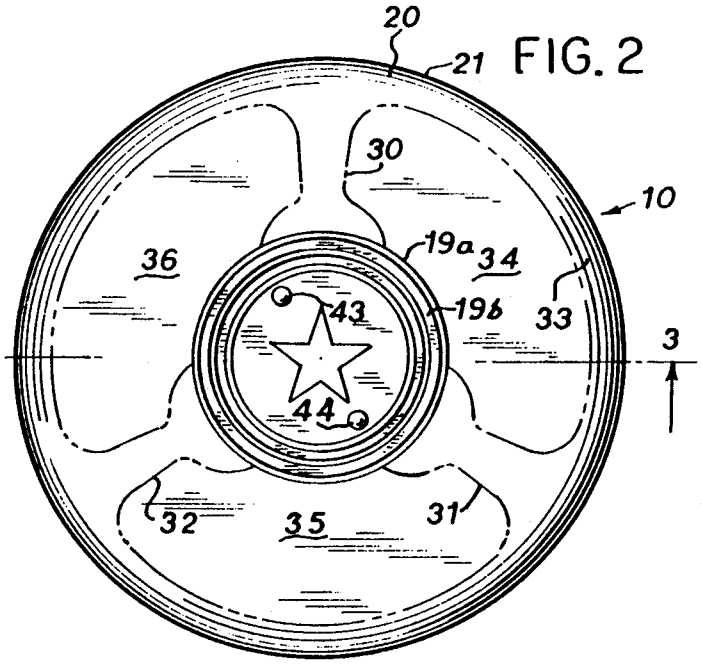
FIG. 2 is a top plan view of the lighted disc of FIG. 1, including a static view of the special lighting effects provided by the present invention.

Referring now to FIG. 4, controller module 13 includes the LED's 23, 24, 25, 26, 27 and 28, which are mounted on circuit board 29 and angularly spaced at 60-degree intervals around its circumference. As seen in FIG. 3, these LED's 23, 24, 25, 26, 27 and 28 are mounted and positioned so that they tilt upward at an angle 63 in the range of 3° to 6° from an axis 64 parallel to upper deck, so that light impinges on and illuminates the underside of the upper deck 18 as well as the rim 21 as seen in FIG. 2. In fact, the light actually is observed to spread around the rim 21, even though it is beamed toward three specific portions of the rim 21. The glowing pattern can be observed from vantage points above the deck, from below the deck and from outside the rim 21 of the disc 10.

As seen in FIG. 2, when the disc 11 is stationary, the six LED's generate a light pattern with radial beam components 30, 31, 32 and a band 33 along the rim 21. The LED's are alternately red and green in color, with FIG. 2 showing the red LED's 23, 25 and 27 "on" and the green LED's 24, 26 and 28 "off". The sectors 34, 35, 36 bounded by beams 30–32 and band 33 are green. The LED's are alternately and rapidly turned on and off, in 1-second intervals, which gives the user the appearance of both colors at the same time to create various patterns on the disc 10 according to the number and arrangement of the LED's.

Two other LED's 40, 41 are angularly spaced 180 degrees apart, and their leads are bent in a hairpin turn to aim the LED's 40, 41, upward through apertures in the upper deck 18. The apertures are covered with spherical windows 43, 44 as seen in FIGS. 1 and 3. When these LED's 40, 41 are illuminated, and the assembled disc 10 spins through the air in flight, these LED's 40, 41 create a solid ring or dashed ring effect, depending on how fast the assembly 10 is spinning.

Figure 8:
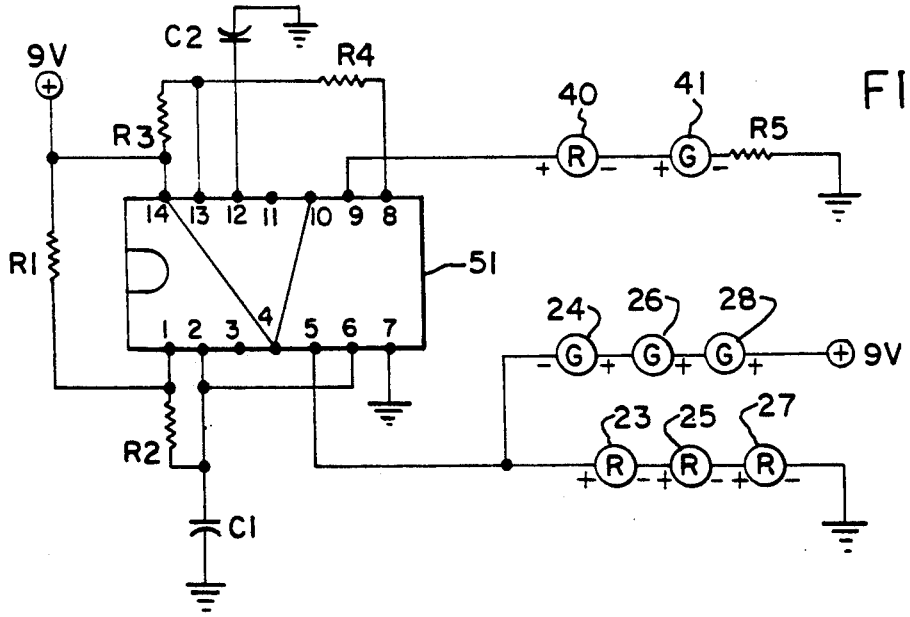
FIG. 8 is an electrical schematic of the controller of FIG. 4.

Referring to FIG. 4, the support structure 12 provides flexible mounting tabs 45, 46, and corner post 47 which extend through apertures 37, 38, 39 in circuit board 29 for holding a 9-volt battery 48 in place. A terminal strap 49 connects the terminals of the battery 48 in an electrical circuit to be described. A pushbutton on-off switch 50 and a timer circuit 51 are also mounted on circuit board 29, along with certain resistors and capacitors which are shown in FIG. 8, relative to the electrical circuit. The circuit board 29 has locating slots 52, 53 for locating the controller module 13 relative to two mounting posts 54, 55 formed in structure 12. Inserts 17 are press fitted into holes in these posts 54, 55 to receive screws 16 as seen in FIGS. 3 and 4.

Figure 7:
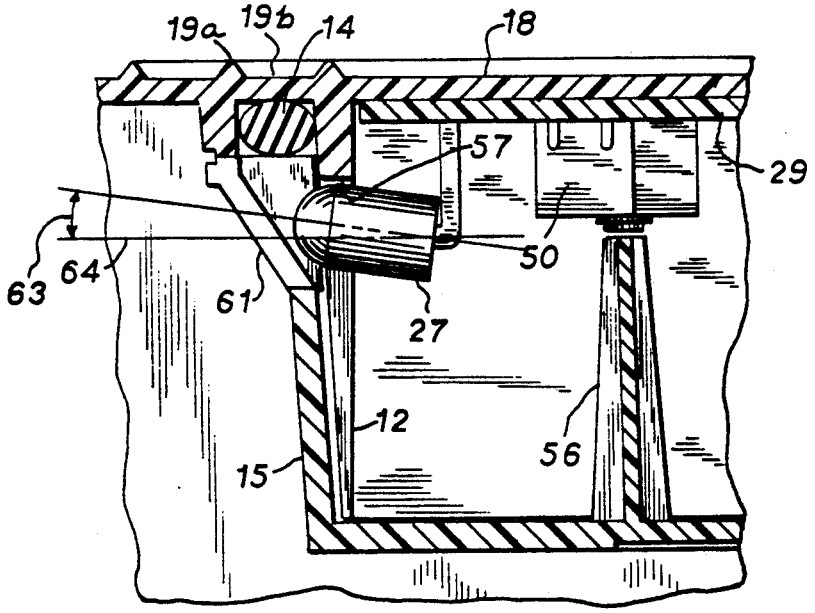
FIG. 7 is a detail sectional view taken in the plane indicated by line 7—7 in FIG. 4.

As seen in FIG. 6, there are two actuating projections 56 formed within hub cap 15. To assemble the disc assembly 10, controller module 13 is located in support structure 12 using posts 54, 55 seen in FIG. 5. The LED's 23, 24, 25, 26, 27 and 28 fit in six corresponding slots 57 in inner wall 58. The inserts 17 are fitted in posts 54, 55, O-ring 14 is positioned in groove 59 formed between inner wall 58 and outer wall 60 of structure 12. O-ring 14 is provided to seal the electrical components against excessive moisture. The cap 15 is fitted over structure 12 and O-ring 14 as seen in FIG. 7. Screws 16 are then placed through holes 62 in the cap 15. The tip of projection 56 is then located over pushbutton switch 50. The second projection 56 is opposite the first to permit the cap 15 to be rotated 180° and still be operationally attached to hub 12. After assembly, the "PUSH ON" portion of cap 15 can be pressed to actuate the switch 50, as seen in FIG. 7, and turn on the electrical circuit. The planar portion of the cap 15 is made thinner and more flexible than the sidewall to accommodate this operation. By pressing the "PUSH ON" portion of cap 15 a second time, the switch 50 is actuated to turn off the electrical circuit.

Also seen in FIG. 6 are some notched windows 61 which are disposed around the base of the cap 15 to correspond to the positions of LED's 23, 24, 25, 26, 27 and 28 when the cap 15 is attached to structure 12. These windows 61 are approximately twice the diameter of the LED nose area. They may be entirely open, or they are covered with a thinner, more translucent portion of material, than the remaining disc 11. As seen in FIG. 7, the LED's are preferably about 1/16 inch inside of each window 61 to cause the beam of light from the LED's to be somewhat diffused and diffracted from passing through the window 61. The LED's 23, 24, 25, 26, 27 and 28 are slanted upward at an angle 63 from 3° to 6° from axis 64, which is parallel to upper deck 18, to cause light to impinge on the underside of the deck 18 as well as on the rim 21 of the disc 11.

Referring to FIG. 8, the electrical operation of the controller module 13 will now be described. The timer circuit 51 is preferably a 556 dual timer TTL circuit connected to resistors R1 (15K ohms), R2 (33K ohms), R3 (2.2K ohms), R4 (15K ohms), R5 (100 ohms) and capacitors C1 (10 μf) and C2 (1 μf) as shown to put the circuit 51 in a mode for generating alternating square wave pulse train at 1 second per pulse from "pin 5". The red LED's 23, 25 and 27 are connected anode-to-cathode in series between "pin 5" of the timer circuit and ground. The LED's 23, 25 and 27 are rated at a sufficient illuminating value to be observed through the translucent or opaque disc. The green LED's 24, 26 and 28 are connected anode-to-cathode in series between a +9-volt supply signal and "pin 5" of the timer circuit. These LED's 24, 26 and 28 are also rated at a sufficient value to be observed through the disc's body. In this example, both the red LED's 23, 25 and 27 and the green LED's 24, 26 and 28 are rated at 600 microcandescents (MCD).

Figure 9:
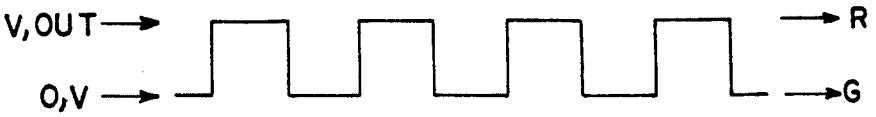
FIG. 9 is a timing diagram of the operation of the circuit seen in FIG. 8.

The output signal from "pin 5" is illustrated in FIG. 9. When "pin 5" goes high to some value, "V OUT", current flows to ground and the red LED's 23, 25 and 27 are illuminated for 1 second. The "pin 5" output then switches low, at which time current shuts off through the red LED's 23, 25 and 27, but at the same time current flows through the green LED's 24, 26 and 28 for 1 second. This is followed by the red LED's 23, 25 and 27 being turned "on" for another 1 second, while the green LED's 24, 26 and 28 are turned "off". The other LED's 40 and 41, shown as red and green, are flashed at a much faster rate, such as 10 times per second, using the "pin 9" output from timer circuit 51.

It should now be apparent that the scope of the invention provides an improved illuminated glowing disc, that enables one to observe the discrete light sources from a variety of vantage points, while providing a very bright and prominent glowing disc. The light sources are centrally located and have no mechanical connections in the deck or rim area, so that flight and use characteristics of the disc are not deterred.

This has been a description of an of how the invention can be carried out. Those of ordinary skill in the art will recognize that various details may be modified in arriving at other detailed embodiments, and these embodiments will come within the scope of the invention.

Therefore, to apprise the public of the scope of the invention and the embodiments covered by the invention, the following claims are made.

I claim:

1. An illuminated flying disc assembly, which comprises:

a disc having an upper deck with a planar major portion, the upper deck extending beyond the planar major portion to a leading edge, with a rim depending from an outer periphery of the leading ledge and defining a downwardly opening cavity along the underside of the upper deck;

power source retaining means generally centrally located on the underside of the upper deck for supporting, and providing electrical connection to, a power source;

a plurality of discrete light sources generally centrally located and spaced below the underside of the planar major portion of the upper deck and disposed around the power source retaining means, the discrete light sources being positioned to beam light radially and outward through the upper deck to the rim, wherein the discrete light sources are of at least two different colors; and controlling means mounted on the underside of the disc for electrical connection to the power source and to the discrete light sources, the controlling means being operable to alternate illumination cycles of the discrete light sources of at least two different colors to create special lighting effects both radially along the upper deck and around the rim area of the disc.

2. The illuminated flying disc assembly of claim 1, wherein the disc is made of a translucent material.

3. The illuminated flying disc assembly of claim 1, wherein the plurality of discrete light sources includes at least two light sources of a first color and at least two light sources of a second color; and wherein the plurality of discrete light sources are disposed alternately and spaced at equal distances no more than ninety angular degrees apart, so as to generate a symmetrical pattern of illuminated portions of light including radial portions and portions on the rim of the disc.

4. The illuminated flying disc assembly of claim 1, wherein the plurality of discrete light sources includes at least three light sources of a first color and at least three light sources of a second color; and wherein the plurality of discrete light sources are disposed alternately and spaced at equal distances approximately sixty angular degrees apart, so as to generate a symmetrical pattern of illuminated portions of light including radial portions and portions on the rim of the disc.

5. An illuminated flying disc assembly, which comprises:

a disc having an upper deck extending to a leading edge, with a rim depending from an outer periphery of the leading ledge and defining a downwardly opening cavity along the underside of the upper deck;

power source retaining means generally centrally located on the underside of the upper deck for supporting, and providing electrical connection to, a power source;

a plurality of discrete light sources generally centrally located on the underside of the upper deck and disposed around the power source retaining means, the discrete light sources being positioned to beam light radially outward toward the rim, wherein the discrete light sources are of at least two different colors;

controlling means mounted on the underside of the disc for electrical connection to the power source and to the discrete light sources, the controlling means being operable to alternate illumination cycles of the discrete light sources of at least two different colors to create special lighting effects both radially along the upper deck and around the rim area of the disc; and wherein the light sources are aimed at an angle from three to six degrees inclined toward the upper deck from a position parallel to the upper deck, so as to illuminate portions of the upper deck and the rim of the disc.

6. The illuminated flying disc assembly of claim 1, wherein the two different colors are complementary colors.

7. The illuminated flying disc assembly of claim 1, wherein the two different colors are red and green.

8. An illuminated flying disc assembly, which comprises:

a disc having an upper deck extending to a leading edge, with a rim depending from an outer periphery of the leading ledge and defining a downwardly opening cavity along the underside of the upper deck;

power source retaining means generally centrally located on the underside of the upper deck for supporting, and providing electrical connection to, a power source;

a plurality of discrete light sources generally centrally located on the underside of the upper deck and disposed around the power source retaining means, the discrete light sources being positioned to beam light radially outward toward the rim, wherein the discrete light sources are of at least two different colors;

controlling means mounted on the underside of the disc for electrical connection to the power source and to the discrete light sources, the controlling means being operable to alternate illumination cycles of the discrete light sources of at least two different colors to create special lighting effects both radially along the upper deck and around the rim area of the disc; and wherein a first one of the discrete light sources of one color is connected between a positive supply voltage and a terminal in the controlling means;

wherein a second one of the discrete light sources of another color is connected between the terminal in the controlling means and ground; and wherein the controlling means is operated to generate a square wave pulse train that alternately operates the discrete light sources.

9. The illuminated flying disc assembly of claim 8, further comprising additional discrete light sources which are connected to a second terminal in the controlling means, and wherein the controlling means operates the additional light sources at a different flash rate than the first and second discrete light sources.

* * * * *